US008469491B2

(12) United States Patent
Yamashita

(10) Patent No.: US 8,469,491 B2
(45) Date of Patent: Jun. 25, 2013

(54) WIRING STRUCTURE FOR ACTUATOR

(75) Inventor: Toru Yamashita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 277 days.

(21) Appl. No.: 13/073,774

(22) Filed: Mar. 28, 2011

(65) Prior Publication Data

US 2012/0069527 A1 Mar. 22, 2012

(30) Foreign Application Priority Data

Sep. 16, 2010 (JP) ..... 2010-207841

(51) Int. Cl.
*B41J 2/14* (2006.01)
*B41J 2/16* (2006.01)

(52) U.S. Cl.
USPC ..... 347/50; 347/58; 347/68

(58) Field of Classification Search
USPC ..... 347/50, 57–58, 68, 70, 71
See application file for complete search history.

(56) References Cited

U.S. PATENT DOCUMENTS

| | | | | |
|---|---|---|---|---|
| 6,532,028 | B1 | 3/2003 | Gailus et al. | |
| 7,036,916 | B2 * | 5/2006 | Sakaida et al. | 347/68 |
| 8,136,923 | B2 * | 3/2012 | Ito | 347/50 |
| 2004/0130594 | A1 | 7/2004 | Watanabe et al. | |
| 2005/0030349 | A1 | 2/2005 | Taira | |
| 2009/0244186 | A1 | 10/2009 | Ito | |
| 2011/0074886 | A1 | 3/2011 | Kubo | |

FOREIGN PATENT DOCUMENTS

| | | | |
|---|---|---|---|
| JP | 2000-246893 | A | 9/2000 |
| JP | 2003-053940 | A | 2/2003 |
| JP | 2004-114520 | A | 4/2004 |
| JP | 2010-199330 | A | 9/2010 |
| JP | 2010-234553 | A | 10/2010 |
| JP | 2011-073244 | A | 4/2011 |
| WO | 01/49493 | A2 | 7/2001 |

OTHER PUBLICATIONS

European Patent Office, European Search Report for European Patent Application No. 11159636.7 (counterpart to above-captioned patent application), dated Dec. 9, 2011.

* cited by examiner

*Primary Examiner* — Juanita D Jackson
(74) *Attorney, Agent, or Firm* — Baker Botts L.L.P.

(57) ABSTRACT

A wiring structure including printed circuits each including: a base member including one end portion facing an actuator and the other end portion of the base member drawn from the one end portion along a face of the actuator and then turned, the other end portion extending in parallel with the one end portion; output terminals formed on the one end portion and configured to output signals to the actuator; a drive IC mounted on the base member and connected to the output terminals by wirings; and input terminal formed on the other end portion and connected to the drive IC by wirings to input signals to the drive IC, wherein the printed circuits are arranged in a predetermined direction along the face of the actuator, wherein the one end portions of the respective base members are arranged in the predetermined direction, and wherein the other end portions of the respective base members are arranged in the predetermined direction.

8 Claims, 9 Drawing Sheets

WIRING STRUCTURE FOR ACTUATOR

CROSS REFERENCE TO RELATED APPLICATION

The present application claims priority from Japanese Patent Application No. 2010-207841, which was filed on Sep. 16, 2010, the disclosure of which is herein incorporated by reference in its entirety.

BACKGROUND OF THE INVENTION

1. Field of the Invention

The present invention relates to a wiring structure including a printed circuit configured to supply a signal to an actuator.

2. Description of the Related Art

There is conventionally known actuators used in various technical fields. Such actuators include an actuator to which is connected a printed circuit having flexibility (i.e., a flexible printed circuit) on which are formed wirings for supplying signals for driving the actuator.

For example, there are known piezoelectric actuators (piezoelectric-elements unit) used for an ink-jet head configured to eject ink from a plurality of nozzles. Each of these actuators is constituted by a plurality of sheets stacked on one another in its thickness direction, and the actuators are bonded to an upper face of a head main body having a multiplicity of nozzles formed therein. To an upper face of each actuator is connected a flexible printed circuit disposed so as to cover the upper face. Each flexible printed circuit is drawn from the upper face of the corresponding actuator in a horizontal direction.

SUMMARY OF THE INVENTION

Meanwhile, the larger the number of elements driven by the actuator (the number of the nozzles of the head in the case of the above-described actuator), the larger the number of wirings required for controlling the elements becomes. Thus, where the actuator is controlled by a single printed circuit, wiring pitches of the printed circuit become considerably narrow, leading to various problems such as a short. In order to solve these problems, it is possible to use a wide printed circuit, but in this case, nonstandardized product has to be used, which leads to higher cost.

In order to solve this problem, it can be considered that the actuator is controlled by using a plurality of conventional printed circuits each having a relatively small width. In this case, in order to make a wiring structure smaller and to achieve easy connection between the printed circuits and a control board for controlling the actuator, the plurality of printed circuits are preferably arranged such that input portions of the plurality of printed circuits (i.e., portions thereof connected to the control board) are positioned at one area. However, the conventional technique does not clarify a structure in which four printed circuits of one head are drawn or extend in parallel with upper faces of the respective actuator are disclosed, but specific arrangement of the printed circuits for making an entire wiring structure smaller.

This invention has been developed in view of the above-described situations, and it is an object of the present invention to provide a compact wiring structure where a plurality of printed circuits are connected to a single actuator.

The object indicated above may be achieved according to the present invention which provides a wiring structure for an actuator, comprising a plurality of printed circuits each including: a flexible base member having a strip shape and curved in a longitudinal direction thereof, the base member including (a) one end portion thereof which faces the actuator and (b) the other end portion of the base member drawn from the one end portion in a drawn direction along a face of the actuator and then turned, the other end portion extending in parallel with the one end portion; a plurality of output terminals formed on the one end portion of the base member and configured to output signals to the actuator by respectively contacting a plurality of contacts disposed on the face of the actuator; a drive IC mounted on a face of the base member and connected to the plurality of output terminals by a plurality of output wirings; and a plurality of input terminal formed on the other end portion of the base member and connected to the drive IC by a plurality of input wirings so as to input signals to the drive IC, wherein the plurality of printed circuits are arranged in a predetermined direction along the face of the actuator, wherein a plurality of the one end portions of a plurality of the base members of the plurality of respective printed circuits are arranged in the predetermined direction, wherein each of the plurality of output terminals is provided on a corresponding one of the plurality of the one end portions, and wherein a plurality of the other end portions of the plurality of the base members of the plurality of respective printed circuits are arranged in the predetermined direction, wherein each of the plurality of input terminals is provided on a corresponding one of the plurality of the other end portions.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which.

DETAILED DESCRIPTION OF THE EMBODIMENT

Hereinafter, there will be described an embodiment of the present invention by reference to the drawings. The present embodiment is an example in which the present invention is applied to an ink-jet printer including an ink-jet head configured to eject ink droplets onto a recording sheet.

Figure 1:
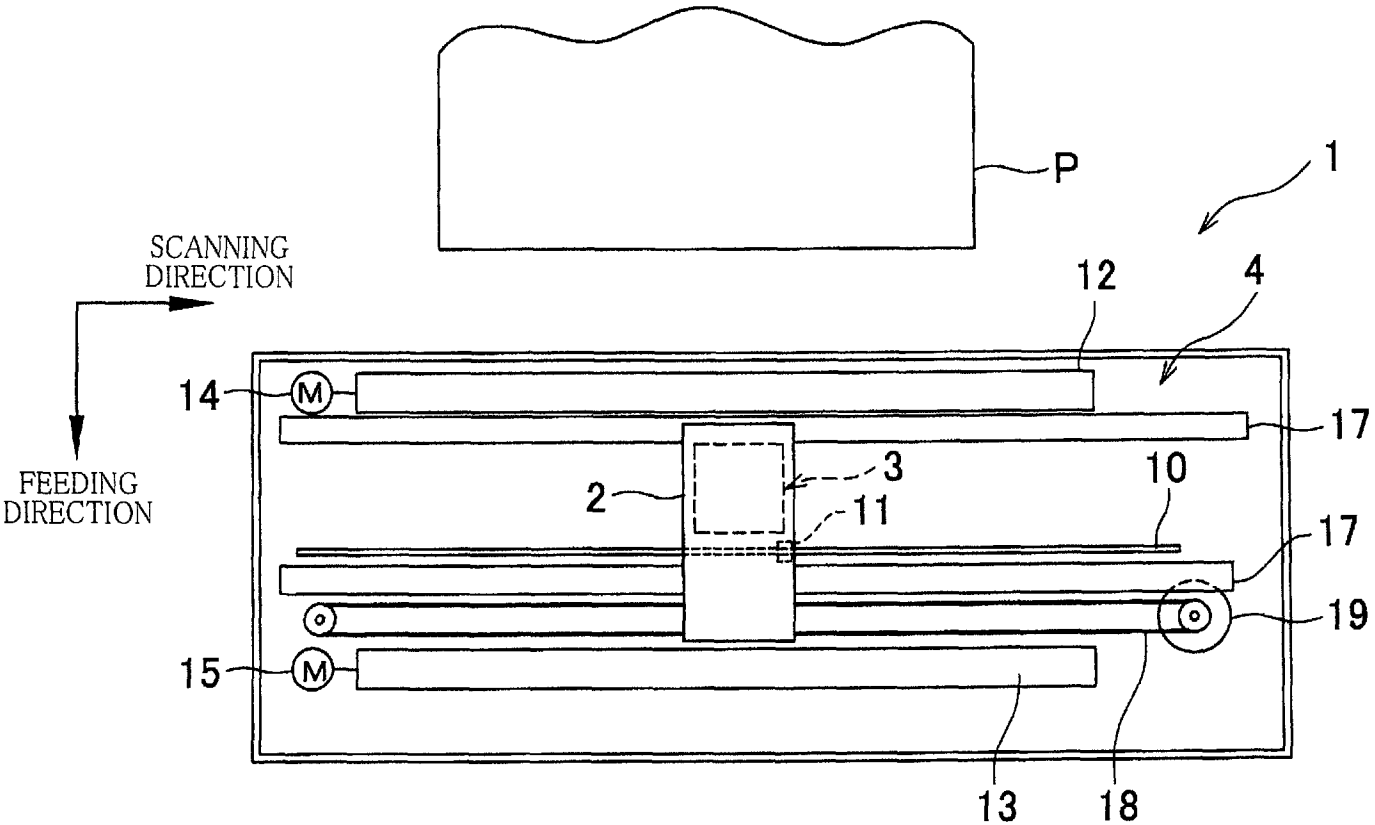
FIG. 1 is a plan view generally showing an ink-jet printer as a present embodiment.

Initially, there will be explained a general structure of an ink-jet printer 1 as the present embodiment with reference to FIG. 1. As shown in FIG. 1, the printer 1 includes: a carriage 2 reciprocable in a predetermined scanning direction (in a rightward and leftward direction in FIG. 1); an ink-jet head 3 mounted on this carriage 2; a feeding mechanism 4 configured to feed or convey the recording sheet P in a feeding direction that is perpendicular to the scanning direction; and so on.

The carriage 2 is reciprocable along two guide shafts 17 extending in parallel with the scanning direction (i.e., in the rightward and leftward direction in FIG. 1). An endless belt 18 is connected to the carriage 2. When the endless belt 18 is rotated or circulated by a carriage drive motor 19, the carriage 2 is moved in the scanning direction in accordance with the rotation of the endless belt 18. It is noted that the printer 1 is provided with a linear encoder 10 having a multiplicity of light transmitting portions (slits) arranged so as to be spaced from one another in the scanning direction. On the carriage 2 is provided a transmission-type photo sensor 11 having a light emitting element and a light receiving element. The printer 1 is configured to recognize a current position of the carriage 2 in the scanning direction on the basis of a counted number (the number of detections) of the light transmitting portions of the linear encoder 10, which counted number is detected by the photo sensor 11 during the movement of the carriage 2.

The head 3 is mounted on this carriage 2. The head 3 has a multiplicity of nozzles 30 (see FIGS. 3 and 4) formed in its lower face (i.e., a face of the head 3 opposite to a face thereof illustrated in FIG. 1). This head 3 is configured to eject ink supplied from ink cartridges, not shown, from the nozzles 30 onto the recording sheet P fed by the feeding mechanism 4 in the feeding direction, i.e., in a downward direction in FIG. 1.

The feeding mechanism 4 includes: a sheet-supply roller 12 disposed on an upstream side of the head 3 in the feeding direction; a sheet-discharge roller 13 disposed on a downstream side of the head 3 in the feeding direction. The sheet-supply roller 12 and the sheet-discharge roller 13 are driven and rotated respectively by a sheet-supply motor 14 and a sheet-discharge motor 15. This feeding mechanism 4 is configured to feed the recording sheet P by the sheet-supply roller 12 from an upper side in FIG. 1 toward the head 3 and is configured to discharge the recording sheet P on which an image, characters, and the like have been recorded by the head 3, toward a lower side in FIG. 1 by the sheet-discharge roller 13.

There will be next explained the head 3. It is noted that, in FIG. 2, a heat sink 61 and a flexible printed circuit (FPC) 60 as one example of another printed circuit are illustrated in cross section for easier understanding purposes though side faces of these elements should be illustrated.

Figure 2:
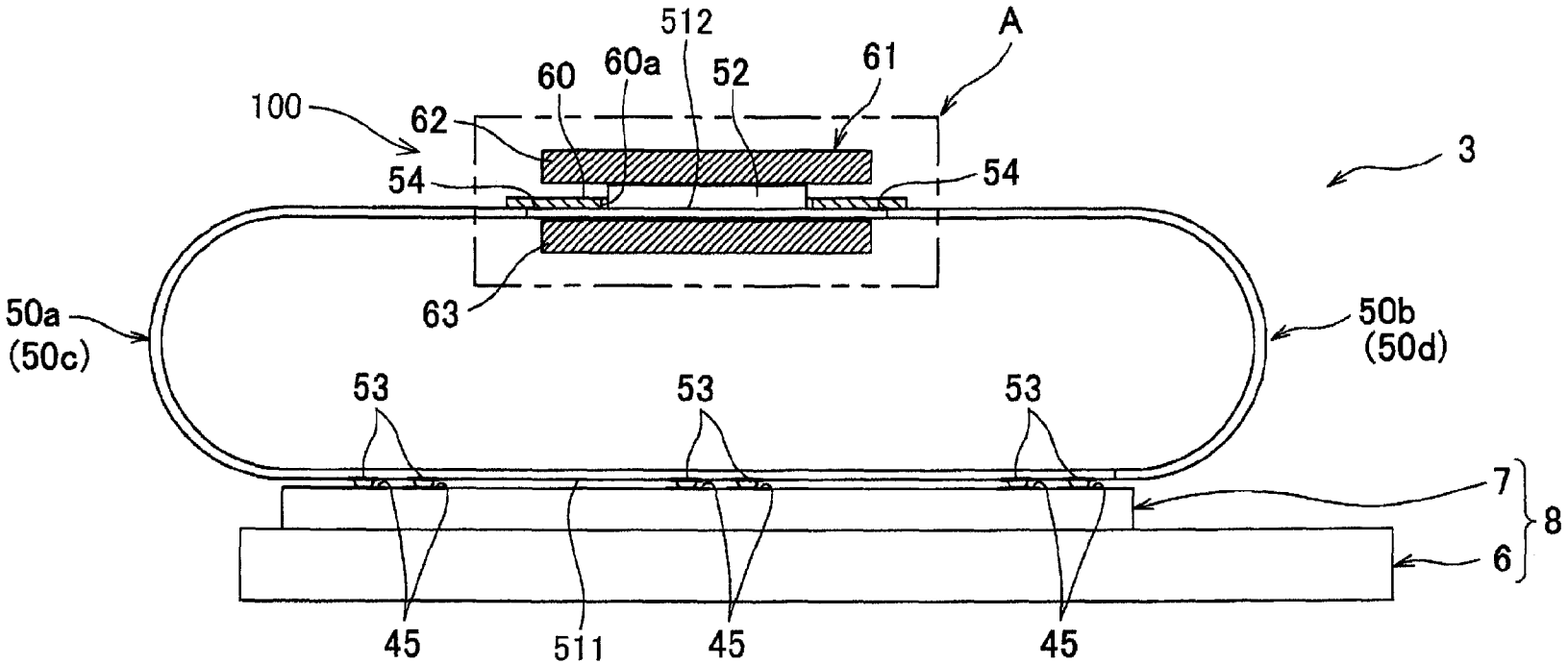
FIG. 2 is a side view of a head as seen in a scanning direction.
Figure 3:
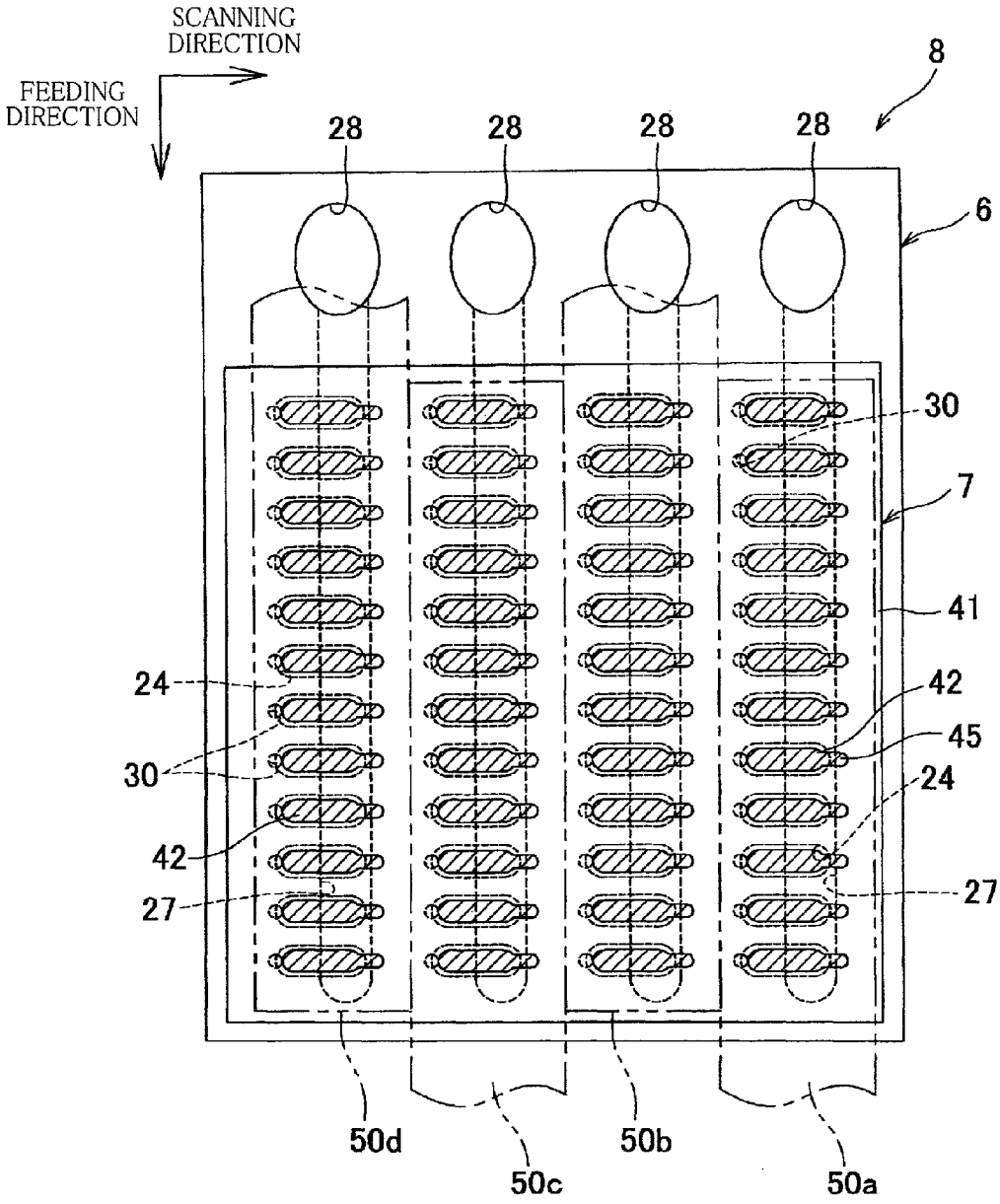
FIG. 3 is a top view of a head main body.

As shown in FIGS. 2 and 3, the head 3 includes a head main body 8. This head main body 8 includes: a channel unit 6 in which are formed ink channels that have the nozzles 30 and pressure chambers 24 formed therein; and a piezoelectric actuator 7 for applying pressures to the ink in the respective pressure chambers 24. It is noted that, on an upper face of the piezoelectric actuator 7 is connected four COFs 50 (Chip-On-Films), each as one example of a printed circuit which is a printed circuit on which a corresponding one of drive ICs 52 is mounted. It is noted that, in FIG. 3, the four COFs 50 (50*a*-50*d*) located over the piezoelectric actuator 7 (see FIG. 2) are illustrated in two-dot chain lines.

Figure 4A:
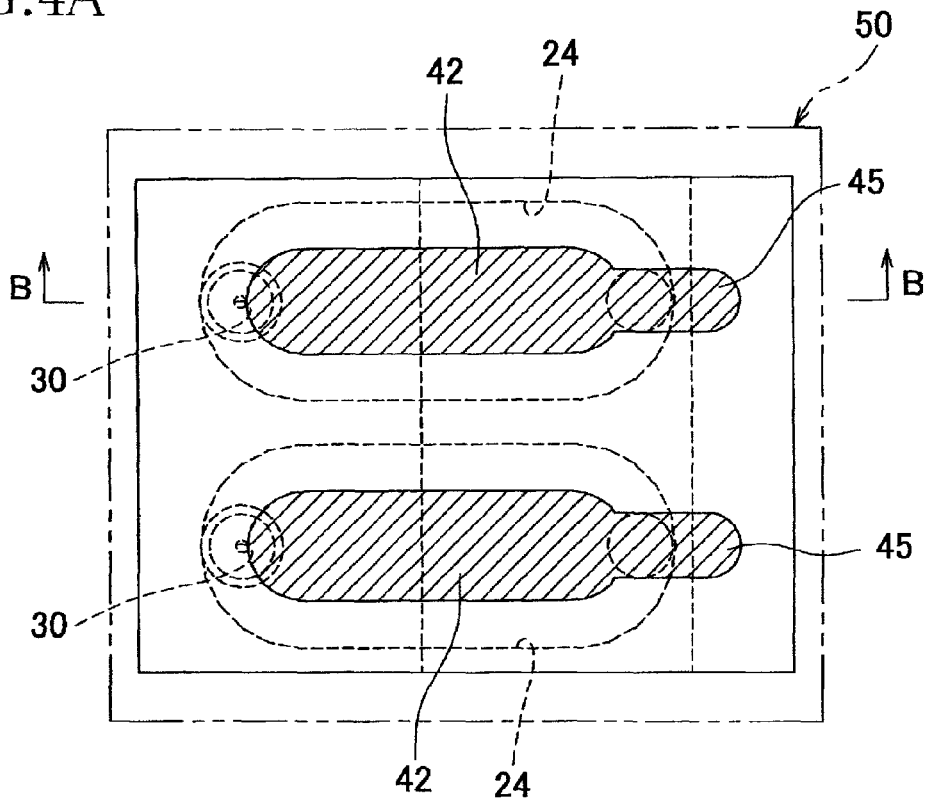
FIG. 4A is a partial enlarged view of FIG. 3.
Figure 4B:
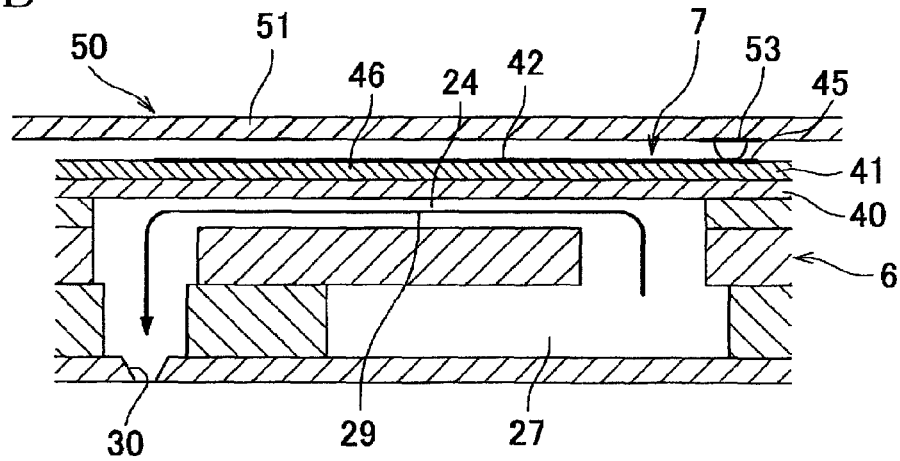
FIG. 4B is a cross-sectional view taken along line B-B.

As shown in FIGS. 3, 4A, and 4B, the channel unit 6 has a laminar structure in which four plates are stacked on or bonded to one another, and the ink channels are formed in the channel unit 6. The nozzles 30 are formed in a lower face of the channel unit 6 (i.e., a face thereof opposite to a face thereof illustrated in FIG. 3). As shown in FIG. 3, each of these nozzles 30 extends in the feeding direction, and these nozzles 30 form four nozzle rows arranged in the scanning direction. The ink of each of four colors, namely, black, yellow, cyan, and magenta is ejected from the nozzles 30 of a corresponding one of the four nozzle rows. In the channel unit 6 are formed the pressure chambers 24 respectively communicated with the nozzles 30. The pressure chambers 24 are also arranged in four rows in correspondence with the four nozzle rows to form four pressure-chamber rows. Further, in the channel unit 6 are formed four manifolds 27 each extending in the feeding direction for supplying the ink of a corresponding one of the four colors to a corresponding one of the four pressure-chamber rows. It is noted that the four manifolds 27 are respectively connected to four ink-supply openings 28 formed in an upper face of the channel unit 6.

Figure 5:
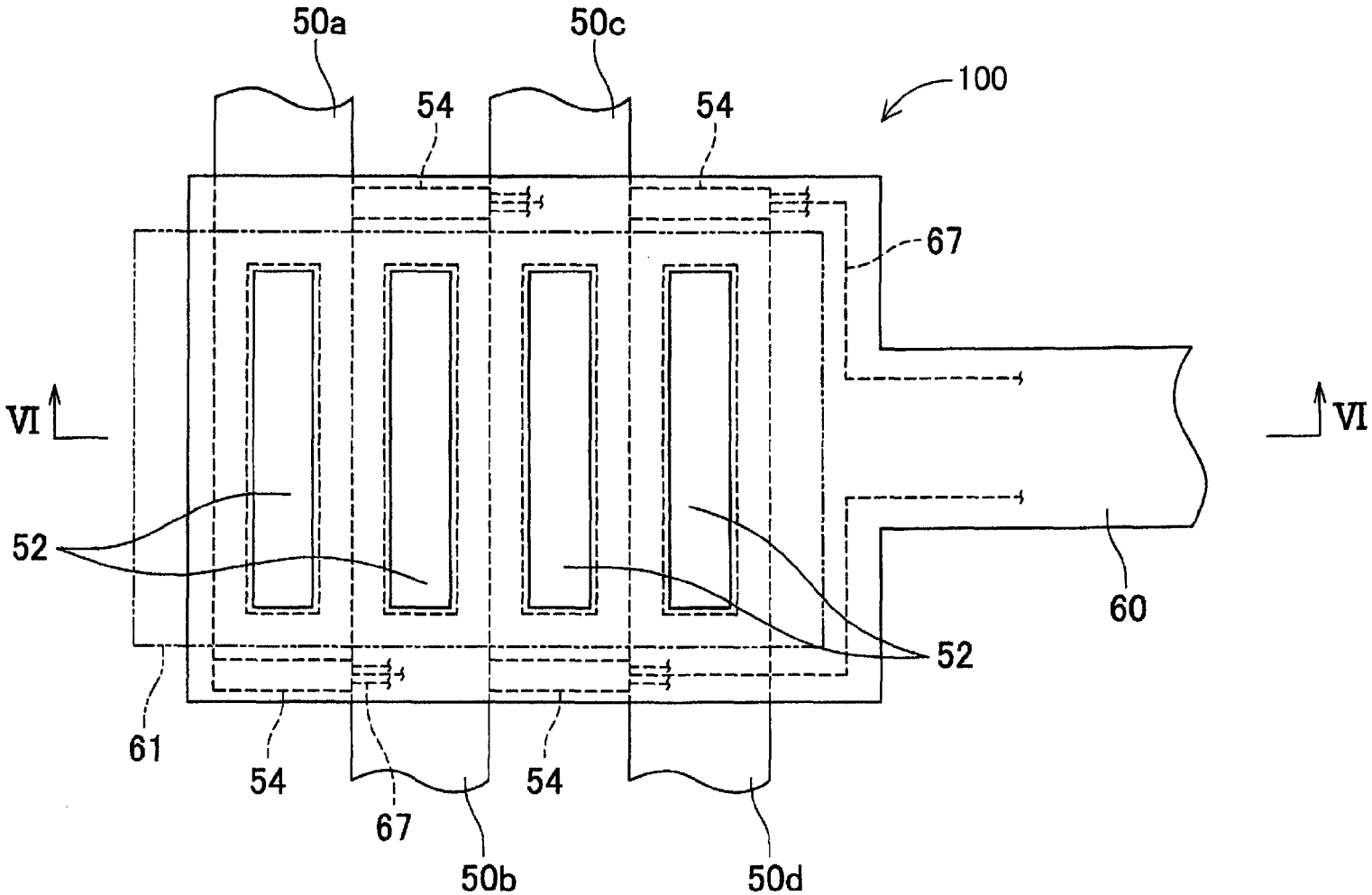
FIG. 5 is a top view showing an area A enclosed by a two-dot chain line in FIG. 2.

As shown in FIG. 5, in the channel unit 6, the manifolds 27 respectively continued to the ink-supply openings 28 are communicated with corresponding ones of the pressure chambers 24, and each pressure chamber 24 is communicated with the corresponding nozzle 30. That is, in the channel unit 6 are formed a plurality of individual ink channels 29 each extending from a corresponding one of the manifolds 27 to a corresponding one of the nozzles 30 via a corresponding one of the pressure chambers 24.

The piezoelectric actuator 7 includes: (a) a vibration plate 40 disposed on the upper face of the channel unit 6 so as to cover the pressure chambers 24; (b) a piezoelectric layer 41 disposed on an upper face of this vibration plate 40 so as to face the plurality of the pressure chambers 24; and (c) a plurality of individual electrodes 42 arranged on an upper face of the piezoelectric layer 41.

The vibration plate 40 is formed of a metal material and bonded to the channel unit 6 so as to be positioned such that the pressure chambers 24 are covered by the upper face of the channel unit 6. Further, the upper face of the vibration plate 40 having conductivity is disposed beneath a lower face of the piezoelectric layer 41, whereby the upper face of the vibration plate 40 acts as a common electrode for generating an electric field for the piezoelectric layer 41 in a thickness direction thereof between the piezoelectric layer 41 and the individual electrodes 42 thereon. The vibration plate 40 as this common electrode is connected to ground wirings of the respective drive ICs 52 which will be described below and thereby always kept at ground potential.

The piezoelectric layer 41 has a flat-plate shape and is formed of a piezoelectric material mainly composed of lead zirconate titanate (PZT) which is a solid solution of lead titanate and zirconate titanate and which has ferroelectricity. As shown in FIG. 4B, this piezoelectric layer 41 is continuously formed on the upper face of the vibration plate 40 so as to expand over or straddle the pressure chambers 24.

The individual electrodes 42 are respectively arranged on portions of the upper face of the piezoelectric layer 41, which portions respectively face the pressure chambers 24. Each of the individual electrodes 42 has a generally oval shape in plan view which is one size smaller than a corresponding one of the pressure chambers 24, and each individual electrode 42 faces a central portion of the corresponding pressure chamber 24. Further, a plurality of contact portions 45 are respectively drawn or extend from end portions of the respective individual electrodes 42 in a longitudinal direction of each individual electrode 42. The contact portions 45 are connectable respectively to a plurality of output terminals 53 of the respective COFs 50.

It is noted that a plurality of portions of the piezoelectric layer 41 which are sandwiched between the respective individual electrodes 42 and the vibration plate 40 as the common electrode function as active portions 46 each of which is polarized in advance in its thickness direction.

To each of the contact portions 45 respectively corresponding to the individual electrodes 42, there is connected a corresponding one of the four COFs 50 on which are respectively mounted the drive ICs 52 for driving the piezoelectric actuator 7. Each of the individual electrodes 42 and the vibration plate 40 as the common electrode is electrically connected to a corresponding one of the drive ICs 52 via wirings formed on a corresponding one of the COFs 50. Further, the COFs 50 are connected to a main control board, not shown, of the printer 1 by the FPC 60 (see FIG. 5). It is noted that a wiring structure 100 including the COFs 50 and the FPC 60, for connecting the piezoelectric actuator 7 and the main control board to each other will be explained in detail later. When having received a command from the main control board, each of the drive ICs 52 supplies drive pulse signals respectively to the individual electrodes 42 to apply a predetermined drive voltage to the active portions 46.

There will be next explained an operation of the piezoelectric actuator 7 when the drive pulse signals have been supplied. It is noted that the following explanation is given by taking one of the individual electrodes 42 for the sake of simplicity. When the drive pulse signal has been supplied from the drive IC 52 to the individual electrode 42, the predetermined drive voltage is applied to the active portion 46 sandwiched between the individual electrode 42 and the vibration plate 40 as the common electrode which is kept at the ground potential, whereby an electric field is applied to the active portion 46 in the thickness direction thereof. Since the direction of this electric field is parallel to a polarization direction of the active portion 46, the active portion 46 is contracted in a planar direction perpendicular to the thickness direction of the active portion 46. Here, since the vibration plate 40 beneath the piezoelectric layer 41 is fixed to the upper face of the channel unit 6, a portion of the vibration plate 40 which covers the pressure chamber is deformed into a convex shape that protrudes toward the pressure chamber 24, in accordance with the contraction of the piezoelectric layer 41 in the planar direction, that is, a unimorph deformation occurs. Thus, a volume of the pressure chamber 24 is decreased to increase a pressure of the ink in the pressure chamber 24, whereby the ink is ejected from the nozzle 30 communicated with the pressure chamber 24.

There will be next explained the wiring structure 100 for connecting the piezoelectric actuator 7 and the main control board of the printer 1 to each other. It is noted that the heat sink 61, which is illustrated in cross section in FIG. 2, is indicated by a two-dot chain line in FIG. 5 for the sake of clarity.

As shown in FIGS. 2 and 3, to each of the plurality of contact portions 45 disposed on the upper face of the piezoelectric actuator 7 is connected a corresponding one of the four COFs 50*a*-50*d*. Each of the COFs 50 is formed of a plastic film having flexibility such as polyimide and includes: a strip-shaped base member 51; the corresponding drive IC 52 mounted on a face of the base member 51; the corresponding output terminals 53 formed on one of opposite end portions of the base member 51 (one end portion 511) in its longitudinal direction (before the base member 51 is mounted on the actuator 7); and a plurality of input terminals 54 formed on the other of the opposite end portions of the base member 51 (the other end portion 512). In other words, as shown in FIG. 2, the one end portion 511 is a portion of a face of the base member 51, which face faces downward, and the other end portion 512 is a portion of a face of the base member 51, which face faces upward.

Figure 7:
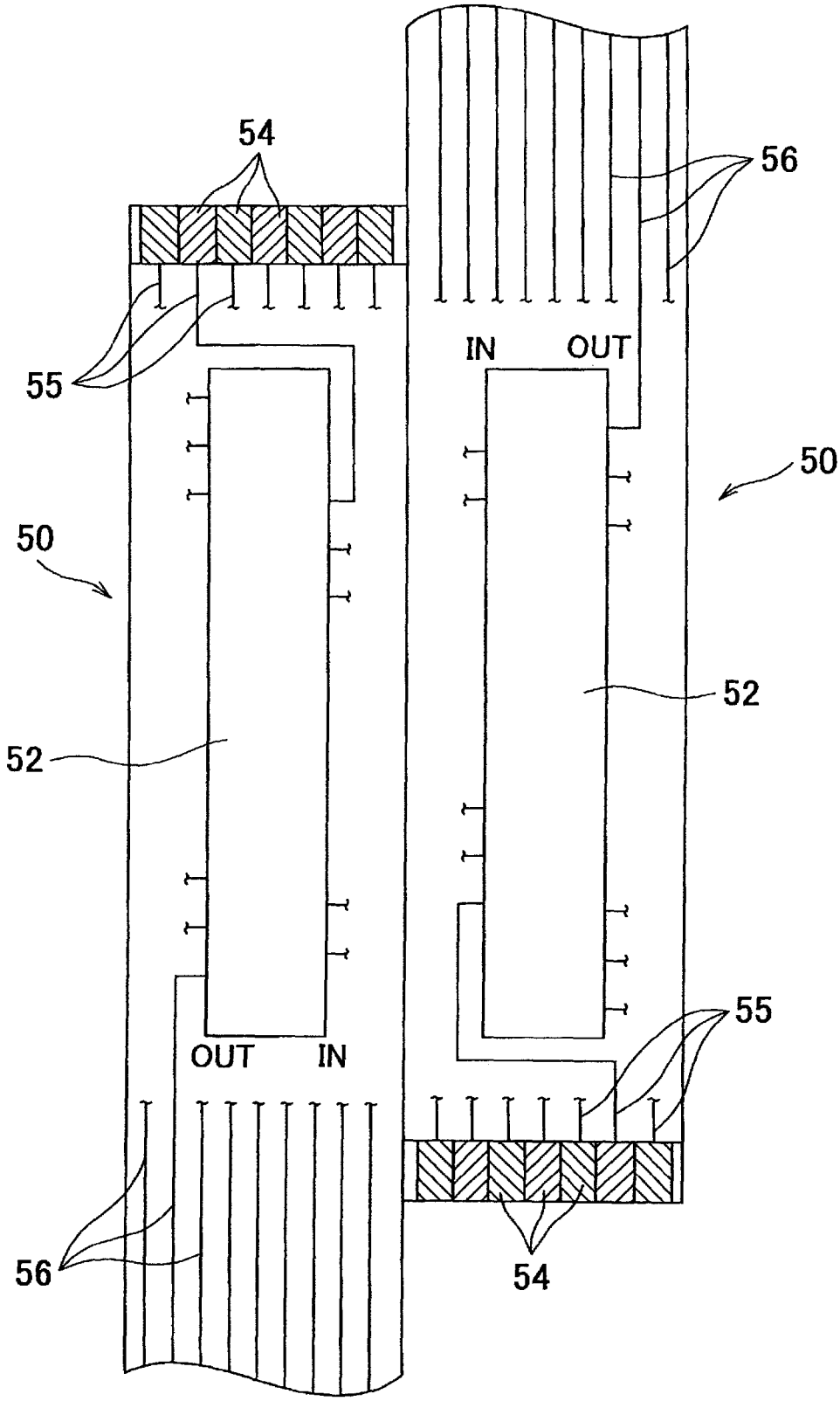
FIG. 7 is a plan view showing end portions of respective two COFs arranged side by side, wherein input terminals are respectively disposed on the end portions.

The one end portion 511 of the base member 51 on which the output terminals 53 are formed is disposed so as to cover the upper face of the piezoelectric actuator 7, thereby electrically bonding the output terminals 53 of the COFs 50 and the respective contact portions 45 of the piezoelectric actuator 7. As shown in FIGS. 2 and 7, the drive IC 52 is mounted at a position near the input terminals 54 formed on the other end portion 512 of the base member 51. The input terminals 54 are connected to the main control board of the printer 1 via the FPC 60 which will be described below. It is noted that, as shown in FIG. 2, the one end portion 511 of each base member 51 is an area which is a part of the base member 51. The one end portion 511 means an area of the base member 51 having a U-shape, which area is located on the lower face of the base member 51 and faces the upper face (a surface) of the piezoelectric actuator 7 as seen in a direction indicated in FIG. 2 (in the scanning direction or in a direction in which the COFs 50 are arranged). The output terminal 53 of the base member 51 is disposed on the one end portion. Further, as shown in FIG. 2, the other end portion 512 of each base member 51 is an area which is a part of the base member 51. The other end portion means an area of the base member 51 having the U-shape, which area is located on the upper face of the base member 51 as seen in the direction indicated in FIG. 2 (the FPC 60 which will be described below is disposed on the upper face). The input terminal 54 of the base member 51 is disposed on the other end portion.

Further, the output terminals 53 and the input terminals 54 are formed on the same face of the base member 51, and the drive IC 52 is also mounted on the same face of the base member 51. That is, as shown in FIG. 2, all the output terminals 53, the input terminals 54, and the drive ICs 52 are mounted on one of inner and outer faces of the base member 51. As shown in FIG. 7, the input terminals 54 and an input portion (IN) of the drive IC 52 are connected to each other by input wirings 55, and an output portion (OUT) of the drive IC 52 and the output terminals 53 (not shown in FIG. 7) are connected to each other by output wirings 56 formed on the base member 51.

As shown in FIGS. 2 and 3, the output terminals 53 provided on the one end portion 511 of the base member 51 are respectively connected to the contact portions 45 of the piezoelectric actuator 7 in each of the four COFs 50, in a state in which the one end portions 511 of the base members 51 of the respective four COFs 50 are arranged in one direction directed horizontally along the upper face of the piezoelectric actuator 7 (in the scanning direction of the carriage 2 in the present embodiment). The base members 51 (with the output wirings 56) of the respective four COFs 50 are drawn from portions of the respective base members 51 on which the output terminals 53 are formed, in parallel with the upper face of the piezoelectric actuator 7 so as to extend in a direction (the feeding direction) perpendicular to a direction in which the four COFs 50 are arranged, and these base members 51 are curved or turned upward in a vertical direction (in a direction away from the piezoelectric actuator 7). As described above, the base members 51 of the respective four COFs 50 are turned in the vertical direction and then turned such that the face of the base member 51, which face faces upward, i.e., the other end portions 512 are parallel to the one end portions 511 and such that the other end portions 512 are overlaid on the one end portions 511 in the vertical direction. In other words, the base members 51 of the respective four COFs 50 are drawn from the one end portions 511 in one direction along the upper face of the piezoelectric actuator 7 and then turned so as to extend in an opposite direction opposite to the one direction along the upper face of the piezoelectric actuator 7. A portion of each base member 51 which extends in the other direction is the other end portion 512. A direction in which the base member 51 of one of the COFs 50 is drawn from the portion of the base member 51 on which the output terminals 53 are formed, and a direction in which the base member 51 of another of the COFs 50 next to the one COF 50 is drawn from the portion of the base member 51 on which the output terminals 53 are formed, are opposite to each other. That is, as shown in FIG. 3, the four COFs 50*a*-50*d* are drawn from the upper face of the piezoelectric actuator 7 alternately toward an upstream side thereof in the feeding direction (an upward direction in FIG. 3) and toward a downstream side thereof in the feeding direction (a downward direction in FIG. 3). In other words, the COFs 50 whose one end face is drawn from the upper face of the piezoelectric actuator 7 toward an upstream side thereof in the feeding direction and the COFs 50 whose one end face is drawn from the upper face of the piezoelectric actuator 7 toward a downstream side thereof in the feeding direction are alternately arranged. As a result, as shown in FIG. 2, the four COFs 50*a*-50*d* are formed in a ring shape in their entirety.

Since the four COFs 50 are curved or turned in a manner described above, the drive ICs 52 are, as shown in FIG. 5, arranged in a row in the direction in which the four COFs 50 are arranged, at positions at which the drive ICs 52 face the upper face of the piezoelectric actuator 7 with a space over the upper face of the piezoelectric actuator 7. Further, since the four COFs 50 are drawn alternately in the opposite directions from the portions of the respective base members 51 on which the output terminals 53 are formed, four groups of the input terminals 54 provided on the other end portions 512 (arranged in the one direction) of the respective base members 51 are arranged alternately on opposite sides of the four drive ICs 52. In other words, groups of the input terminals 54 located on an upstream side of the four drive ICs 52 in the feeding direction and groups of the input terminals 54 located on a downstream side of the four drive ICs 52 in the feeding direction are alternately arranged in the scanning direction.

The input terminals 54 of the four COFs 50 are connected commonly to the FPC 60 and connected to the main control board, not shown, via the FPC 60. As shown in FIGS. 2 and 5, since the output terminals 53 and the input terminals 54 are formed on the same face of each base member 51, and the base member 51 is curved or turned in the direction away from the piezoelectric actuator 7, the input terminals 54 are located on a face of the base member 51, which face does not face the piezoelectric actuator 7. That is, connection faces of the input terminals 54 which are connected to the FPC 60 face in the direction away from the piezoelectric actuator 7, specifically, in the upward direction. The FPC 60 is stacked on the four COFs 50 from an upper side thereof such that the FPC 60 covers all the connection faces of the input terminals 54 of the four COFs 50 at a time, thereby connecting between (a) terminals, not shown, formed on a lower face of the FPC 60 so as to be connected to the main control board by wirings 67 and (b) the connection faces of the input terminals 54 of the four COFs 50.

In the wiring structure 100 of the piezoelectric actuator 7 of the present embodiment, the four COFs 50 have the ring shape in their entirety, and their drive ICs 52 and input terminals 54 are collectively disposed on an upper side of the piezoelectric actuator 7, thereby providing a compact wiring structure. Further, the input terminals 54 of the four COFs 50 are located at one area, thereby facilitating connecting the single FPC 60 to the input terminals 54.

Further, since the four groups of the input terminals 54 of the four COFs 50 are arranged alternately on opposite sides of the four drive ICs 52, the input terminals 54 are never next to one another in the scanning direction among ones of the COFs 50 which are arranged side by side in the scanning direction as shown in FIGS. 5 and 7. Accordingly, mutual interference between the input terminals 54 is less likely to occur, thereby preventing a short, mixing of noises into signals, and the like among ones of the input terminals 54 which are arranged side by side. For example, where the input terminals 54 include: a terminal connected to a power source so as to supply a relatively high drive voltage to the piezoelectric actuator 7; and a terminal for ground connection and where the input terminals 54 of the COFs 50 next to each other are arranged side by side, a short is more likely to occur between (a) the terminal provided on one of the COFs 50 so as to be connected to the power source and (b) the terminal, provided on the other of the COFs 50, for the ground connection. However, in the above-described structure, the groups of the input terminals 54 of the adjacent two COFs 50 are not arranged side by side, thereby preventing a short.

As shown in FIG. 7, in two COFs 50 arranged side by side, the input wirings 55 drawn to one of the drive ICs 52 and the input wirings 55 drawn to the other of the drive ICs 52 are located on opposite sides of the drive ICs 52, and the output wirings 56 drawn from the one drive IC 52 and the output wirings 56 drawn from the other drive IC 52 are located on opposite sides of the drive ICs 52. Accordingly, the input wirings 55 of one of the COFs 50 and the output wirings 56 of the other of the COFs 50 are next to each other. Here, the input wirings 55 are wirings for transmitting, to the drive ICs 52, control signals that have been transmitted from the main control board, and the output wirings 56 are wirings for supplying, to the piezoelectric actuator 7, drive signals that have been transmitted from the drive ICs 52. A direction in which a current flows through the input wirings 55 and a direction in which a current flows through the output wirings 56 are opposite to each other. In this case, radiation noises radiated or emitted from the two types of the wirings 55, 56 cancel each other, thereby reducing the radiation noises.

Where the groups of the input terminals 54 of the two COFs 50 are arranged side by side, wirings connected to the input terminals 54 arranged side by side are disposed so as to be closer to each other on the FPC 60. As a result, wiring pitches become partially narrow on the FPC 60. However, where groups of the input terminals 54 of the four COFs 50 are arranged alternately on opposite sides of the four drive ICs 52 as described above, wirings connected to the input terminals 54 of the COFs 50 can be spread out or distributed on the FPC 60. Accordingly, it is possible to suppress a degree of local concentration of wirings on the FPC 60, thereby reliably obtaining relatively wide pitches.

Figure 6:
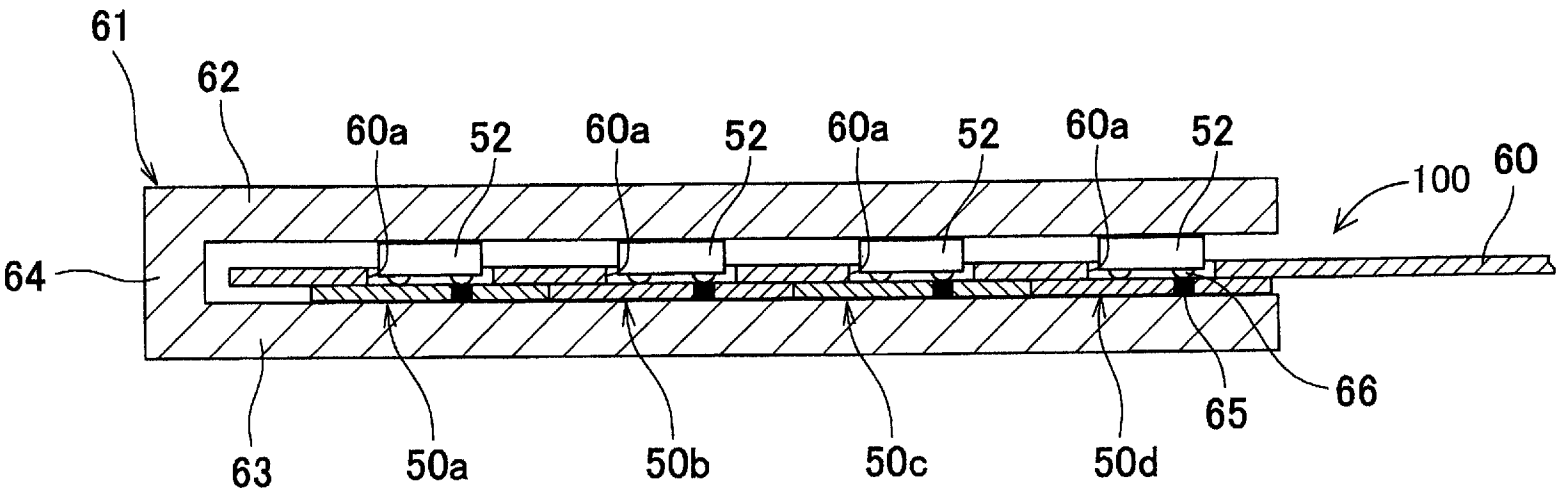
FIG. 6 is a cross-sectional view taken along line VI-VI in FIG. 5.

It is noted that, as shown in FIG. 2, the connection faces of the input terminals 54 which are connected to the FPC 60 and the face on which the drive ICs 52 are mounted are the same face of the base member 51 as described above. Thus, when the FPC 60 is stacked from above on the other end portion 512 of the base member 51 on which the input terminals 54 are formed, the drive ICs 52 are interposed between the base member 51 and the FPC 60, which may cause a poor connection between the input terminals 54 and the FPC 60. In order to solve this problem, as shown in FIGS. 5 and 6, the FPC 60 of the present embodiment has four through holes 60*a* each having a shape one size larger than an outer shape of a corresponding one of the drive ICs 52 as seen in the vertical direction. These four through holes 60*a* are arranged at pitches which are the same as pitches at which the drive ICs 52 are arranged. In this structure, when the FPC 60 is stacked on the other end portions 512 of the four COFs 50, the four drive ICs 52 arranged in a row are exposed upward from the FPC 60 through the respective four through holes 60*a*. As a result, it is possible to prevent a poor connection of the input terminals 54 due to the drive ICs 52 interposed between the base members 51 of the respective COFs 50 and the FPC 60. Further, when the input terminals 54 of the four COFs 50 and the FPC 60 are connected to each other, the four drive ICs 52 are respectively fitted into the four through holes 60*a* of the FPC 60, thereby making it possible to easily position the COFs 50*a*-50*d* and the FPC 60 to each other.

Further, the wiring structure 100 of the present embodiment includes the heat sink 61 (as one example of a heat spreading plate) for spreading or dissipating heat generated on the drive ICs 52 of the respective COFs 50. As shown in FIG. 6, the heat sink 61 is formed by a metal member having a three-sided rectangular shape in cross section. The heat sink 61 includes: two flat-plate portions 62, 63 arranged in parallel with each other; and a connecting portion 64 connecting between one end portion 511 of the respective two flat-plate portions 62, 63. The four COFs 50 respectively including the drive ICs 52 are sandwiched between the two flat-plate portions 62, 63 of the heat sink 61.

Here, the four drive ICs 52 are arranged in a row, and as shown in FIG. 6, the flat-plate portion 62 as an upper portion of the heat sink 61 is disposed so as to extend in the direction in which the drive ICs 52 are arranged, whereby the flat-plate portion 62 can be brought into contact with the four drive ICs 52 at the same time. As thus described, the four drive ICs 52 are arranged in a row in the present embodiment. Accordingly, when compared to the case where the drive ICs 52 are dotted, it is possible to effectively spread or radiate heat by using the compact heat sink 61 and by bringing the flat-plate portion 62 into contact with the four drive ICs 52.

Further, the flat-plate portion 63 as a lower portion of the heat sink 61 is held in contact with the lower faces of the base members 51 of the respective COFs 50, heat transferred from the drive ICs 52 to the respective base members 51 is radiated or dissipated from the flat-plate portion 63, thereby increasing a heat radiation effect. Further, as shown in FIG. 6, through holes are respectively formed in the COFs 50 at positions at which the drive ICs 52 are respectively mounted. These through holes are respectively filled with conductive materials 65 which are respectively connected to dummy terminals 66 of the respective drive ICs 52. The conductive materials 65 in the respective through holes are held in contact with the flat-plate portion 63 of the heat sink 61, thereby further improving the heat radiation effect for radiating the heat from the lower faces of the respective COFs 50. Further, since the upper flat-plate portion 62 and the lower flat-plate portion 63 are connected to each other by the connecting portion 64, heat transferred from the drive ICs 52 to the upper flat-plate portion 62 is also dissipated from the lower flat-plate portion 63 through the connecting portion 64.

Figure 8:
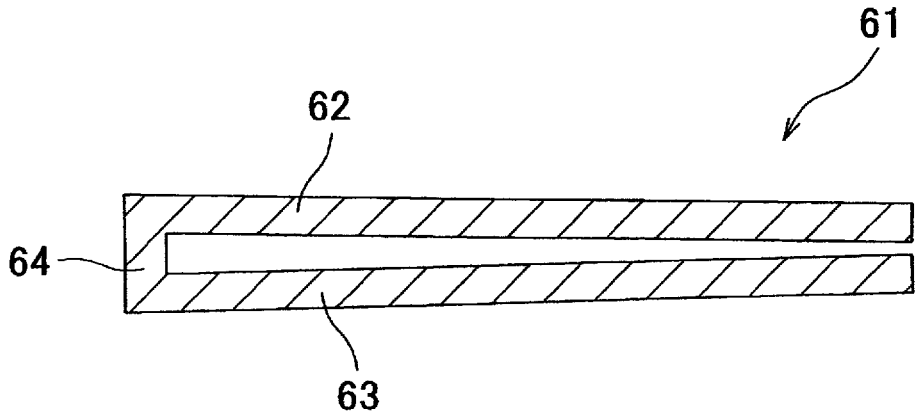
FIG. 8 is a cross-sectional view of a heat sink.

In order for reliable contact between the upper flat-plate portion 62 and the four drive ICs 52 and reliable contact between the lower flat-plate portion 63 and the lower faces of the respective COFs 50, it is preferable to exert a force in a direction in which the two flat-plate portions 62, 63 are moved closer to each other (i.e., a force in a direction in which the two flat-plate portions 62, 63 sandwich the COFs 50 therebetween). For example, a structure shown in FIG. 8 may be employed. That is, a clearance between the two flat-plate portions 62, 63 becomes narrower toward an opening of the heat sink 61 (i.e., in a rightward direction in FIG. 8), and the flat-plate portions 62, 63 are pressed onto the drive ICs 52 and the respective COFs 50 by a spring property of an entirety of the heat sink 61 when the COFs 50 are inserted into the heat sink 61 from the opening thereof in a state in which the clearance between the two flat-plate portions 62, 63 is widened. Instead of this structure, the two flat-plate portions 62, 63 may be urged so as to be moved closer to each other by an urging means such as a spring provided outside the heat sink 61.

It is noted that, though not shown, in order that the structure including: the other end portions 512 of the respective COFs 50 on which the drive ICs 52 are respectively mounted and the groups of the input terminals 54 are respectively formed; the FPC 60 connected to the input terminals 54 of the respective COFs 50; and the heat sink 61 is positioned on an upper side of the upper face of the piezoelectric actuator 7 so as to be spaced from the upper face, a support member is preferably provided for supporting this structure from a lower side thereof or for suspending or moving this structure upward from an upper side thereof.

There will be next explained modifications of the above-described embodiment. It is noted that the same reference numerals as used in the above-described embodiment are used to designate the corresponding elements of modifications explained below, and an explanation of which is dispensed with.

First Modification

The FPC 60 connecting between (a) the COFs 50 connected to the piezoelectric actuator 7 and (b) the main control board is not limited to that of the above-described embodiment and may be variously modified.

Figure 9:
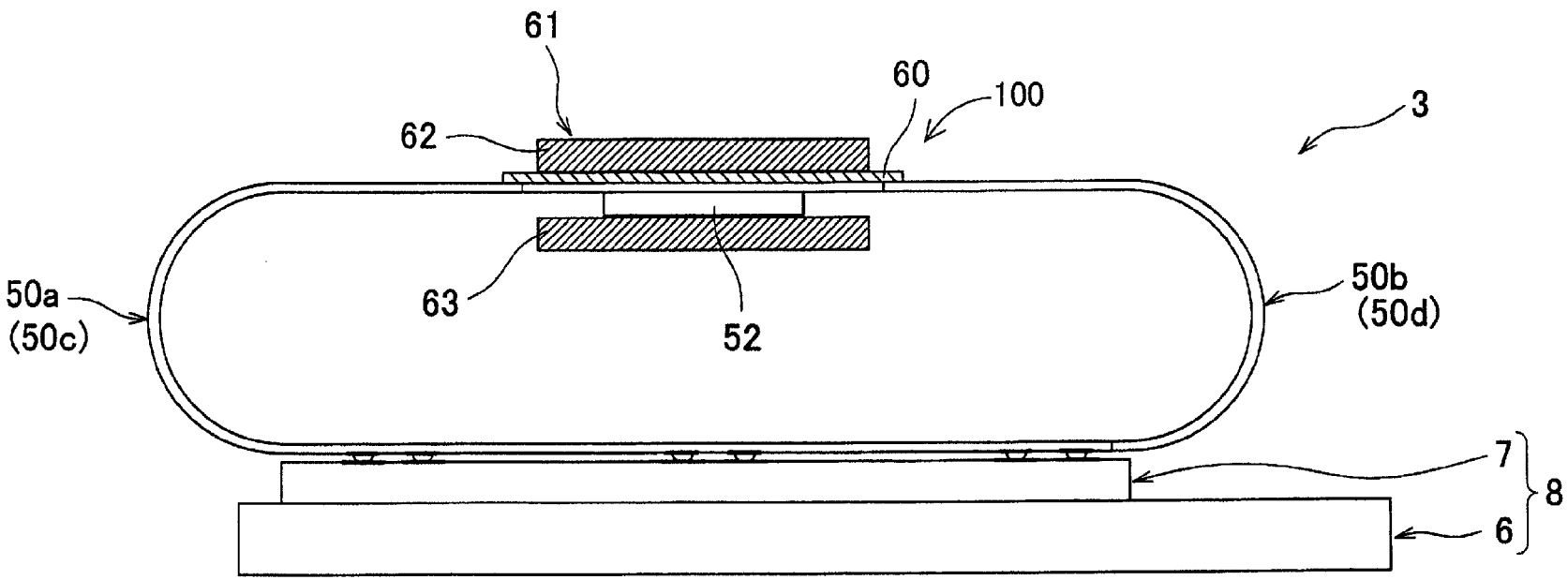
FIG. 9 is a side view of an ink-jet printer as a modification of the embodiment, wherein FIG. 9 corresponds to FIG. 2.

For example, as shown in FIG. 9, where a face of each base member 51 on which the drive IC 52 is mounted and a face of the base member 51 on which the input terminals 54 are formed (i.e., the connection face connected to the FPC 60) are not the same face, the drive IC 52 is not located between the FPC 60 and the COF 50 when the FPC 60 is stacked on the COF 50. Accordingly, the through holes respectively for exposing the drive ICs 52 do not need to be formed in the FPC 60. Instead of this structure, two or more FPCs 60 may be connected to the input terminals 54 of the COFs 50.

Second Modification

In the above-described embodiment, the heat sink 61 includes the two flat-plate portions 62, 63 respectively contactable with the drive ICs 52 and the lower faces of the respective COFs 50, it is not necessary for the heat sink 61 to include both of these two flat-plate portions 62, 63, and one of them may be omitted. However, since it is preferable that the heat sink 61 directly contacts the drive ICs 52 for a heat radiation efficiency, the heat sink 61 preferably includes at least the flat-plate portion 62 which is to contact the drive ICs 52.

Third Modification

An actuator to which the present invention can be applied is not limited to the piezoelectric actuator, and the present invention may be applied to an actuator of various driving types. Further, the present invention may be applied to an actuator for driving a device other than the ink-jet head.

What is claimed is:

1. A wiring structure for an actuator, comprising a plurality of printed circuits each including:

a flexible base member having a strip shape and curved in a longitudinal direction thereof, the base member including (a) one end portion thereof which faces the actuator and (b) the other end portion of the base member drawn from the one end portion in a drawn direction along a face of the actuator and then turned, the other end portion extending in parallel with the one end portion;

a plurality of output terminals formed on the one end portion of the base member and configured to output signals to the actuator by respectively contacting a plurality of contacts disposed on the face of the actuator;

a drive IC mounted on a face of the base member and connected to the plurality of output terminals by a plurality of output wirings; and a plurality of input terminal formed on the other end portion of the base member and connected to the drive IC by a plurality of input wirings so as to input signals to the drive IC, wherein the plurality of printed circuits are arranged in a predetermined direction along the face of the actuator, wherein a plurality of the one end portions of a plurality of the base members of the plurality of respective printed circuits are arranged in the predetermined direction, wherein each of the plurality of output terminals is provided on a corresponding one of the plurality of the one end portions, and wherein a plurality of the other end portions of the plurality of the base members of the plurality of respective printed circuits are arranged in the predetermined direction, wherein each of the plurality of input terminals is provided on a corresponding one of the plurality of the other end portions.

2. The wiring structure according to claim 1, wherein the plurality of printed circuits are arranged such that a plurality of the respective drive ICs of the plurality of respective printed circuits are arranged in the predetermined direction.

3. The wiring structure according to claim 2, wherein the plurality of drive ICs are arranged so as to be spaced from the face of the actuator in a direction perpendicular to the face of the actuator.

4. The wiring structure according to claim 2, wherein the plurality of input terminals respectively provided on the plurality of printed circuits are arranged alternately on opposite sides of the plurality of drive ICs in the drawn direction of the base member as seen in the predetermined direction.

5. The wiring structure according to claim 4, wherein the plurality of printed circuits include two printed circuits arranged side by side, and wherein the base member of one of the two printed circuits and the base member of the other of the two printed circuits are respectively drawn in opposite directions respectively from portions of the respective base member, wherein the plurality of output terminals are respectively formed on the portions.

6. The wiring structure according to claim 2, further comprising a heat spreading plate extending in the predetermined direction and configured to spread heat generated by the plurality of drive ICs.

7. The wiring structure according to claim 1, further comprising another printed circuit to which the plurality of input terminals of the plurality of respective printed circuits are commonly connected.

8. The wiring structure according to claim 7, wherein each of the plurality of printed circuits has (a) a connection face to which the another printed circuit is connected and (b) a mount face on which a corresponding one of a plurality of the respective drive ICs is mounted, the connection face and the mount face being provided on the same face of a corresponding one of a plurality of the base members, wherein the another printed circuit is stacked on the plurality of printed circuits so as to cover the connection faces of the plurality of respective printed circuits at one time, and wherein the another printed circuit has a plurality of through holes formed therein respectively for exposing the plurality of drive ICs.

* * * * *